US007032256B2

(12) United States Patent
Contadini

(10) Patent No.: US 7,032,256 B2
(45) Date of Patent: Apr. 25, 2006

(54) TANK TOILET WITH AUTOFLUSHER

(75) Inventor: Carl D. Contadini, Terryville, CT (US)

(73) Assignee: Waterbury Companies, Inc., Waterbury, CT (US)

( * ) Notice: Subject to any disclaimer, the term of this patent is extended or adjusted under 35 U.S.C. 154(b) by 185 days.

(21) Appl. No.: 10/685,826

(22) Filed: Oct. 14, 2003

(65) Prior Publication Data

US 2005/0076425 A1 Apr. 14, 2005

(51) Int. Cl.
*E03D 5/10* (2006.01)

(52) U.S. Cl. ..... 4/406

(58) Field of Classification Search ..... 4/405–406
See application file for complete search history.

(56) References Cited

U.S. PATENT DOCUMENTS 2,061,310 A * 11/1936 Kleiser, Jr. ..... 4/406
3,082,433 A * 3/1963 Armstrong et al. ..... 4/333
3,090,967 A * 5/1963 Erhardt et al. ..... 4/397
3,541,614 A * 11/1970 Zorn ..... 335/255
4,141,091 A * 2/1979 Pulvari ..... 4/313
4,225,986 A * 10/1980 Mauk ..... 4/324
4,941,215 A * 7/1990 Liu ..... 4/406
5,603,127 A * 2/1997 Veal ..... 4/246.1
5,901,384 A * 5/1999 Sim ..... 4/313
6,643,853 B1 * 11/2003 Wilson et al. ..... 4/249
2004/0154087 A1 * 8/2004 Hogues, Jr. ..... 4/405

* cited by examiner

*Primary Examiner*—Charles E. Phillips
(74) *Attorney, Agent, or Firm*—Carmody & Torrance LLP

(57) ABSTRACT

An arrangement for flushing a toilet of the type that comprises a toilet bowl and a toilet tank. In one embodiment, the arrangement comprises a handle assembly comprising a manually actuatable handle that provides a flush signal to the flush valve flapper lifting assembly in response to manual actuation of the handle. In another embodiment, a flush valve actuation assembly, comprising a handle assembly that comprises at least one sensor for detecting the presence of a user in a target area, is mountable in the aperture through a sidewall through which a conventional handle, comprising a lift arm to lift a conventional chain to pivot a conventional flush valve flapper, is mountable.

39 Claims, 11 Drawing Sheets

TANK TOILET WITH AUTOFLUSHER

BACKGROUND OF THE INVENTION

This invention relates generally to automatic flushing systems for toilets, and more particular, to an automatic flushing system for toilets, wherein the toilet is of the type that includes a toilet bowl and an operatively coupled toilet tank.

Toilets comprising a toilet tank/bowl combination with autoflushing capabilities are known, and are the subject of at least two U.S. Patents. For example, U.S. Pat. No. 5,603,127 describes the use of infrared transmitters that transmit an infrared signal to a sensing area directly in front of a toilet bowl to sense the presence of a user in the sensing area. Once the user has left the sensing area, the automatic flushing system will provide a main flush. The '127 patent describes the use of a single housing unit in which both the infrared sensors and the flush motor are positioned. Another example of a toilet with autoflushing capabilities is described in U.S. Pat. No. 5,901,384. A further known system provides the IR sensor on the wall of the restroom and detects the presence of the user from this remote location (i.e. the wall).

The inventors of the present invention note that these prior art systems lack certain desirable features and capabilities.

For example, it is believed that these prior art patented systems cannot be easily retrofitted into existing toilets. That is, it is a perceived disadvantage of the prior art that existing toilets cannot be easily modified to incorporate such autoflushing capabilities. For example, many of the prior art systems describe the use of a single housing unit that includes both the motion sensor(s) and the flushing mechanism, thus contributing to the disadvantage that easy retrofitting of such prior art autoflushing systems is not achievable. Furthermore, the known system in which the IR sensor is mounted on the wall suffers from the disadvantage that vandalism of the IR sensor, as but one example, would easy disable the system from proper operation. Also, such an arrangement is less than aesthetically pleasing.

Accordingly, further advancements in the art are desirable. For example, it would desirable to provide an autoflushing system that is more easily retrofittable into existing toilets of the type with a conventional tank and bowl. Additionally, it would be desirable to provide an autoflushing system that is more resilient to vandalism and is more aesthetically pleasing. Thirdly, it would be desirable to provide an autoflushing system that is less conspicuous than that found in the prior art. The present invention overcomes the perceived deficiencies in the prior art as well as provides the objectives and advantages set forth above and below.

SUMMARY AND OBJECTIVES OF THE INVENTION

It is an object and advantage of the present invention to introduce and thus provide an improved autoflush system for use in a toilet of the type having a toilet tank and toilet bowl.

It is a further object and advantage of the present invention to provide an autoflush system that can be more easily retrofitted for an existing toilet of the type having a toilet tank and toilet bowl.

Another object and advantage of the present invention to provide an autoflush system that is less prone to vandalism and is aesthetically pleasing.

Yet another object and advantage of the present invention to provide an autoflush system that is less conspicuous when installed than prior art arrangements.

Still another object and advantage of the present invention to provide an autoflush system that does not require any change in habit or accustomed use by a user thereof.

Further objects and advantages of this invention will become more apparent from a consideration of the drawings and ensuing description.

The invention accordingly comprises the features of construction, combination of elements and arrangement of parts that will be exemplified in the disclosure hereinafter set forth, and the scope of the invention will be indicated in the claims.

To overcome the perceived deficiencies in the prior art and to achieve the objects and advantages set forth above and below, the present invention is, generally speaking, directed to an arrangement for flushing a toilet of the type that comprises a toilet bowl and a toilet tank operatively coupled to the toilet bowl, wherein the toilet tank has a flush valve which provides a conduit for water to flow from the toilet tank to the toilet bowl when the toilet is flushed, wherein the flush valve includes a valve seat and a pivotable flush valve flapper which opens and closes the valve, wherein the arrangement comprises a flush valve flapper lifting assembly, positioned in the toilet tank, for pivoting the flush valve flapper from its closed position to its open position in response to a flush signal; a handle assembly comprising a manually actuatable handle, operatively coupled to the flush valve flapper lifting assembly, for providing the flush signal to the flush valve flapper lifting assembly; wherein the handle assembly transmits the flush signal to the flush valve flapper lifting assembly in response to manual actuation of the handle.

In another preferred embodiment, a flush valve actuation arrangement for replacing a flushing assembly of the type used for flushing a toilet of the type that comprises a toilet bowl and a toilet tank is provided. Here, the flush valve actuation assembly comprises a handle assembly that comprises at least one sensor for detecting the presence of a user in a target area; and a flush valve flapper lifting assembly, operatively coupled to the housing assembly and positioned in the toilet tank, for pivoting the flush valve flapper from its closed position to its open position in response to a flush signal; wherein the housing assembly transmits the flush signal to the flush valve flapper lifting assembly; and wherein the toilet tank comprises an aperture through a sidewall through which a conventional handle, comprising a lift arm to lift a conventional chain to pivot a conventional flush valve flapper, is mountable, and wherein the handle assembly is secured to the toilet tank through the aperture.

The handle assembly may also include a pushbutton for automatically sending a "finished" signal to the controller, wherein in response to receipt of the "finished" signal from the pushbutton, the controller transmits the "flush" signal to the flush valve lifting assembly to initiate a flush.

The present invention is widely applicable and can be used for the aforementioned constructed toilets in a wide range of areas of interest, such as, by example and not limitation, homes, hospitals, offices both industrial, commercial and/or professional, as well as all other industrial, commercial and domestic areas where a toilet of the type having a toilet tank and toilet bowl are present.

BRIEF DESCRIPTION OF THE DRAWINGS

The above set forth and other features of the invention are made more apparent in the ensuing Description of the Preferred Embodiments when read in conjunction with the attached Drawing, wherein.

Identical reference numerals in the figures are intended to indicate like parts, although not every feature in every figure may be called out with a reference numeral.

DESCRIPTION OF THE PREFERRED EMBODIMENTS

Figure 1:
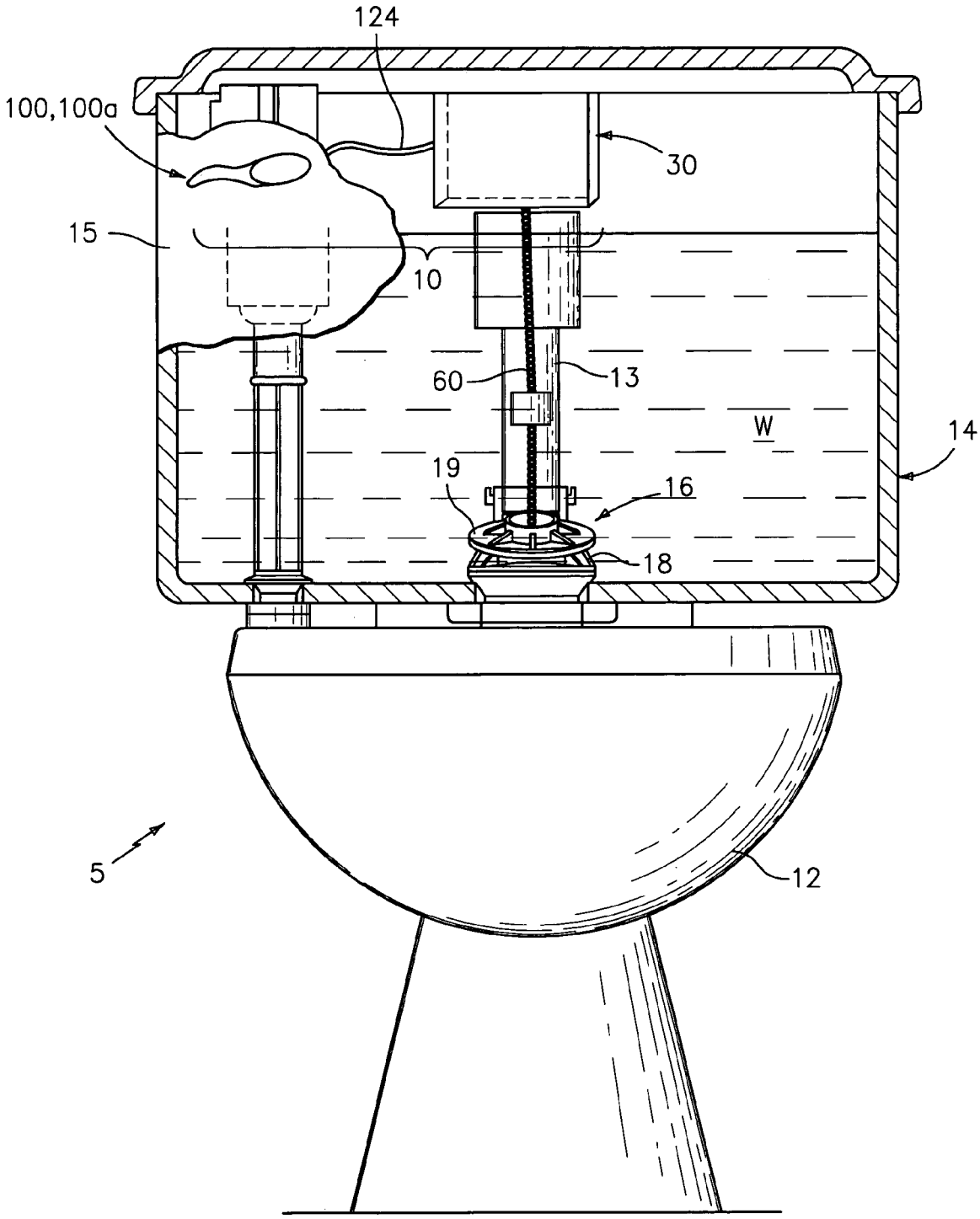
FIG. 1 is a front elevational view of a toilet with a toilet tank shown partially cut away, having an autoflush system constructed in accordance with a first embodiment of the present invention.
Figure 2:
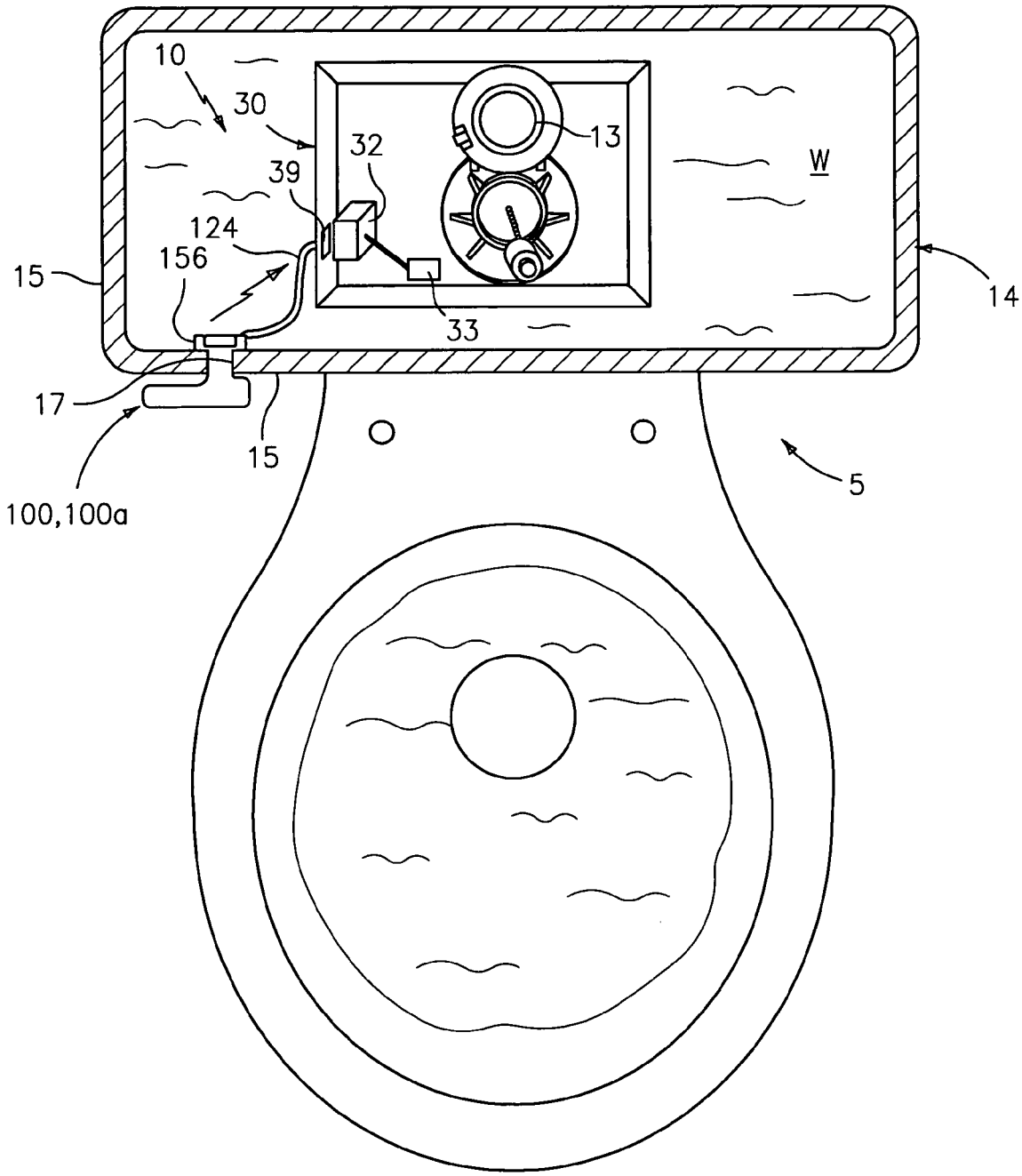
FIG. 2 is top down view looking into the toilet tank of FIG. 1 also showing features and construction of the present invention (although the flush valve flapper lifting assembly is shown to be transparent for ease of understanding)

Reference is first generally made to FIGS. 1 and 2, which illustrate an arrangement, generally indicated at 10, for automatically flushing a toilet of the type that comprises a toilet bowl, generally indicated at 12, and a toilet tank operatively coupled to toilet bowl 12 and generally indicated at 14. The toilet, generally indicated at 5, is of the type that has a flush valve 16 which provides a conduit for water W to flow from toilet tank 14 to toilet bowl 12 when the toilet is flushed. As is quite old in the art, flush valve 16 includes a valve seat 18 and a pivotable flush valve flapper 19 which opens and closes valve 16.

Autoflush arrangement 10 ("arrangement 10"), in its broadest embodiment, comprises a handle assembly, generally indicated at 100, 100*a* and a flush valve flapper lifting assembly 30 which is operatively coupled to handle assembly 100, 100*a* and positioned in toilet tank 14. The main function of assembly 30 is to pivot flush valve flapper 19 from its closed position to its open position to effectuate a flush. Lifting assembly 30 initiates the operation to pivot flush valve flapper 19 in response to a "flush" signal from handle assembly 100, 100*a*. Working together, handle assembly 100, 100*a*, which preferably comprises a manually actuatable handle 110, 110*a*, provides the "flush" signal to flush valve flapper lifting assembly 30.

As a first feature of the present invention, handle assembly 100, 100*a* transmits the "flush" signal to flush valve flapper lifting assembly 30 in response to manual actuation of handle 110, 110*a*. Therefore, it is a feature of the present invention that handle assembly 100, 100*a* detects manual actuation of handle 110, 110*a*, and thus more specific reference to FIGS. 3–4 shall now be had.

To detect manual actuation of handle 110, 110*a*, handle assembly 100, 100*a* preferably comprises a switch or other actuation detector, generally indicted at 120. If needed for the desired switch or actuation detector assembly as will be described below, a corresponding component of switch/detector 120 can be located on handle 110, 110*a*, such as on the side facing handle assembly faceplate 130. Switch/detector 120 may be of several variations, all of which would fall within the scope of the present invention.

Additionally, other means for detecting the manual actuation of handle 110, 110*a* can be used, with such other constructions also falling within the scope of the present invention. For example, switch/detector 120 may be in the form of a switch that operates by the detection or changing of a magnetic field, it may be a wetted switch operated by a switch position change, it may comprise a coil plunger core arrangement operating signal, may be by use of a magnet in conjunction with a Hall-effect transistor, may utilize some form of a circuit capacitance change signal by the closeness of a user's hand, or may be of some other mechanical, electromechanical or electronic type, all of which is within the scope of one skilled in the art to design and implement and within the scope of the claims herein. Accordingly, it can be seen that one or more components, such as those coupled to or mounted in or on faceplate 130 and/or handle 110, 110*a*, would be used.

Handle assembly 100, 100*a* would then be constructed by coupling the respective handle 110 or 110*a* to faceplate 130 by use of screws/plugs/pins 135 or other coupling/locking means. Handle 110, 110*a* is rotatably mounted on a faceplate stem 138 of faceplate 130. A spring 140 is provided to spring bias the respective handle back to its rest position after rotation by a user after use of the toilet in a contemplated manner. A slot 141 is provided in faceplate 130 to bias the spring back to its initial position after rotation.

Once handle assembly 100, 100*a* has detected manual actuation of handle 110, 110*a*, it must be able to transmit the "flush" signal to flush valve flapper lifting assembly 30. Accordingly, handle assembly 100, 100*a* comprises a controller 123, preferably mounted on a PC board 121, that is responsive to the switching of switch/detector 120 (i.e. for example, the closing or opening thereof), which is indicative of a manual actuation by the user. How the "flush" signal is transmitted to flush valve flapper lifting assembly 30 will be further disclosed below, as reference will now be made to another specific feature of handle assembly 100, 100*a*.

Specifically, handle assembly 100, 100*a* may also comprise at least one sensor, generally indicated at 20, for detecting the presence of a user in a target area. Practically speaking, the user will be a person, and the target area will be that area in front of (and/or on) toilet bowl 12. That is, sensor 20 operates to sense when a user approaches toilet 5, presumably to use it, and when the person has left the target area, presumably having finished using toilet 5. For purposes of a courtesy flush as more fully discussed below, the sensor can also determine for how long a user is sensed in the target area. Sensor 20 may be IR, PIR, RF, light, or sonar, by way of example and not limitation. In the preferred embodiment, sensor 20 is mounted on PC board 121.

The present invention discloses one sensor, generally indicated at 20, but it should be understood that a plurality of sensors, to provide the aforementioned functionality, is contemplated hereby. For this reason, the description in U.S. Pat. No. 5,603,127 regarding the detection of a user in the target area is incorporated by reference as if fully set forth herein.

In one embodiment sensor 20 is an IR sensor, and thus comprises a transmitter for emitting at least one radiation beam to the target area and a detector that is responsive to a reflected radiation beam emitted from the radiation beam transmitter and reflected off of a user in the target area. Particulars of such a sensor, or plurality of sensors, are widely available, well-known and understood by one skilled in the art, and described in sufficient detail in U.S. Pat. No. 5,603,127, the subject matter of which is incorporated by reference herein, so as to fully enable the present invention. Accordingly, for purposes of brevity, no further details as to the manner in which such sensors detect users in the target area are deemed to be needed. In another embodiment, a light sensor is used, wherein a photocell measures a change in ambient light to detect the presence or absence of the user in the target area.

In accordance with the present invention, controller 123 is responsive to a "finished" signal from sensor 20 that is indicative of the intensity of the reflected beam. More specifically, it is contemplated that sensor 20 will operate to first detect a user's presence. Presumably, arrangement 10 would not want to initiate a flushing cycle until the user has left the target area, thus presumably being finished using the toilet.

However, the present invention contemplates a courtesy flush feature. The courtesy flush feature provides a courtesy flush of the toilet after a predetermined time and while a user is detected in the target area. The courtesy flush freshens the toilet bowl 12 and removes any residue therefrom. The main flush will occur when the user moves out of the target area as explained above, and the courtesy flush feature can be switched on or off by a courtesy flush switch (not shown). As such, if a courtesy flush option is provided, sensor 20 would comprise a timer to determine when such a flush was needed and/or desired. As such, the detector could send a similar "finished" signal to controller 123 under such a determination.

Accordingly, it is contemplated that sensor 20 will continually monitor or otherwise detect the presence of the user until that user leaves the target area. Once the user has left the target area, sensor 20 sends the "finished" signal to controller 123. Other features may be incorporated into sensor 20, such as a time delay to wait a predetermined period of time (i.e. one to several seconds) after the presence of the user has ceased to be detected. In this way, inadvertent flushing can be avoided.

A decorative and/or transparent cover 127 may be screwed, snap-fitting or otherwise coupled/secured onto handle 110, 110*a* so as to cover and protect sensor 20.

Once the "finished" signal has been transmitted to controller 123, either after a manual actuation of handle 110, 110*a* or from sensor 20, handle assembly 100, 100*a* transmits a "flush" signal to a flush valve flapper lifting assembly 30.

As alluded to above, the present invention provides several arrangements for transmitting the "flush" signal from handle assembly 100, 100*a* to flush valve flapper lifting assembly 30, all of which are illustrated in FIGS. 1 and 2, although only one of which are needed (i.e. both hardwiring and wireless transmission between handle assembly 100, 100*a* and flush valve flapper lifting assembly 30 are not needed).

Figure 3:
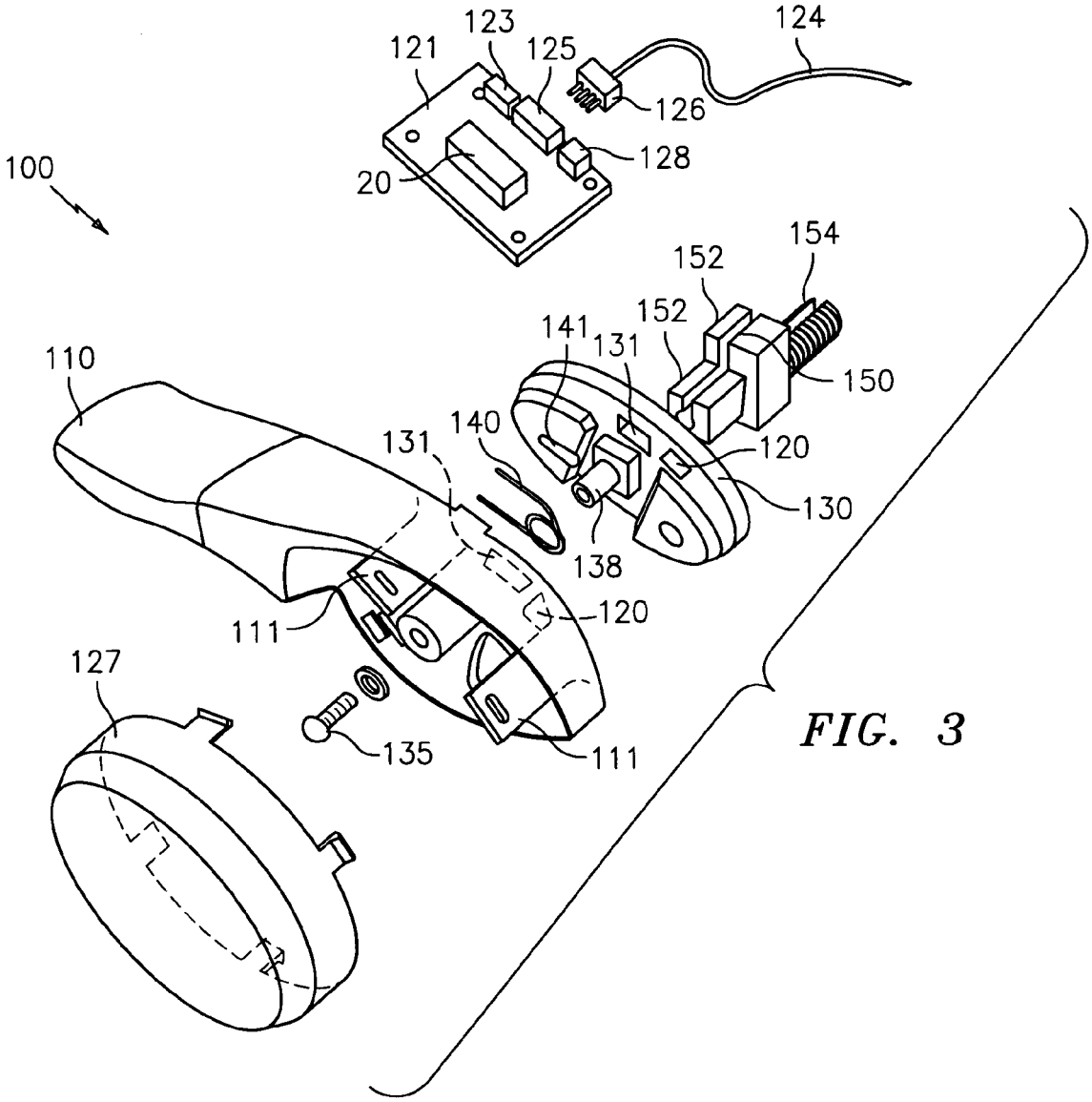
FIG. 3 is an exploded view of a handle assembly constructed in accordance with a preferred embodiment of the present invention.
Figure 4:
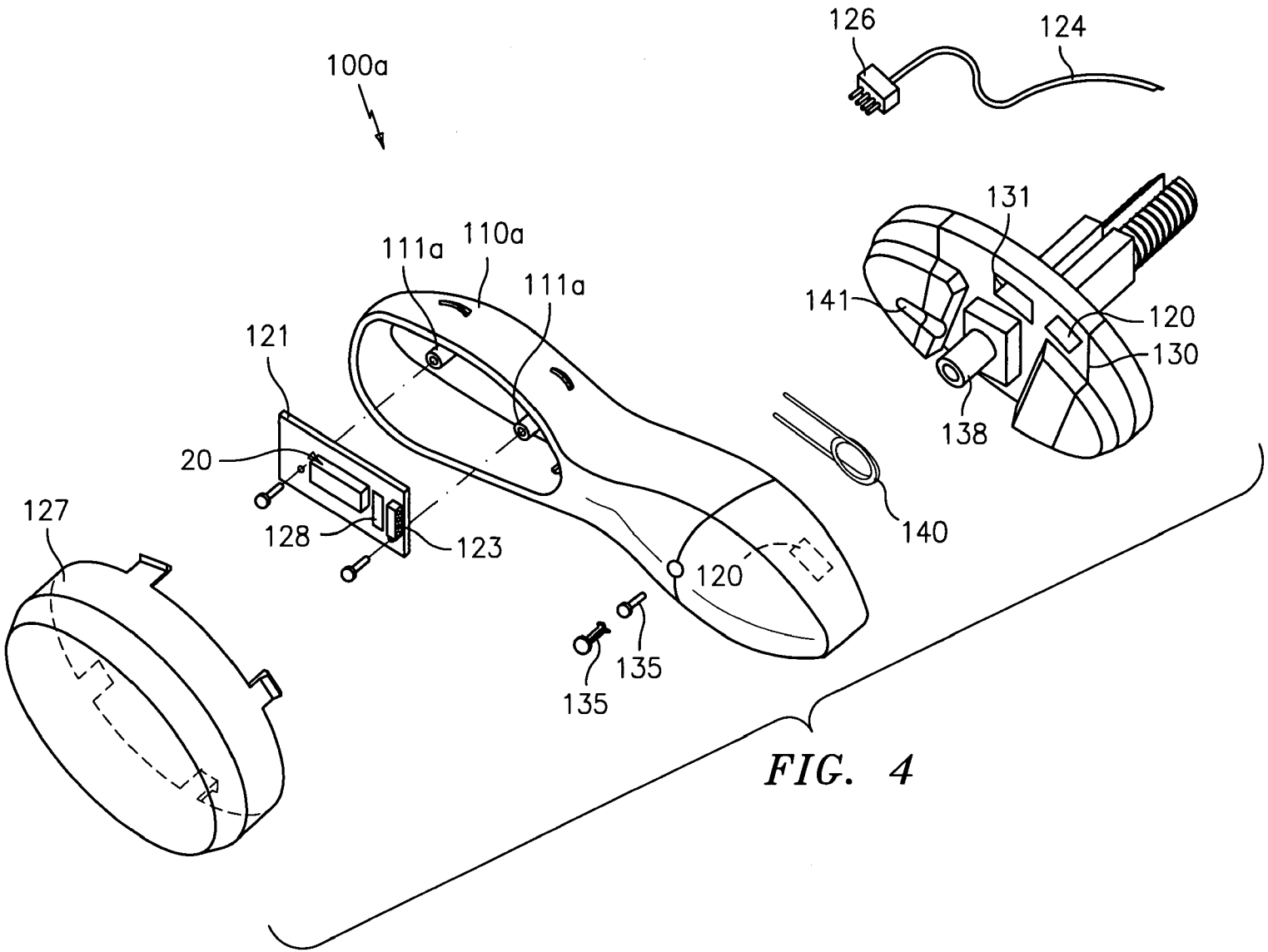
FIG. 4 is an exploded view of a handle assembly constructed in accordance with another preferred embodiment of the present invention.

In one embodiment, controller 123 will transmit the "flush" signal to flush valve flapper lifting assembly 30 via an electrical wire 124 which is plugged into a single or multipin connector 125 on PC board 121. As such, a connector 126 may have a plug in capability to PC board 121 in a manner illustrated in FIG. 3. Electrically coupling controller 123 to connector 125 in the manner illustrated in FIG. 3 is well within the purview of one skilled in the art. Preferably, PC board 121 is mounted in handle 110, 110*a*, so corresponding slots 131 may be provided in faceplate 130 and handle 110, 110*a* to receive wire 124 and the end of connector 126 therethrough. In FIGS. 3 and 4, respectively, PC board 121 is shown to be mounted on posts 111, 111*a*. If hardwiring is used, a complementary connector 39 (FIGS. 1, 7) to that of connector 125, may be provided in flush valve flapper lifting assembly 30.

On the other hand, the present invention provides for a wireless transmission of the "flush" signal from handle assembly 100, 100*a* to flush valve flapper lifting assembly 30.

In a specific embodiment, the "flush" signal is transmitted by a transmitter 128, operatively coupled to controller 123 in handle assembly 100, 100*a*, to flush valve flapper lifting assembly 30. In this arrangement, flush valve flapper lifting assembly 30 comprises a receiver 32 to receive the "flush" signal.

In the wireless configuration, the "flush" signal may be transmitted from handle assembly 100, 100*a* to flush valve flapper lifting assembly 30 by IR, PIR, RF, light or sonar, by way of example and not limitation. Accordingly, transmitter 128 and receiver 32 are complementarily designed. Whether by hardwire or wireless transmission, the "flush" signal is transmitted to flush valve flapper lifting assembly 30, which is then transmitted to a controller 33, operatively coupled to connector 39 and/or receiver 32, in assembly 30. Clearly, both forms of wired and wireless communication are not necessary, but are provided together for ease of discussion.

In accordance with one of the objects and advantages of the present invention, flush valve actuation arrangement 10 (i.e. arrangement 10), can replace and/or be retrofitted (or sold new) into existing flushing assemblies of the type used for flushing a toilet of the type that comprises a toilet bowl and a toilet tank operatively coupled to the toilet bowl. Accordingly, such toilet tanks will comprise an aperture through a sidewall through which a conventional handle, comprising a lift arm to lift a conventional chain to pivot a conventional flush valve flapper, is mountable. In accordance with the present invention, handle assembly 100, 100*a* is secured to toilet tank 14 through the aperture.

In particular, it is preferably that the handle assembly comprises a stem that is passable through the aperture in the sidewall of the toilet tank, and wherein the handle assembly comprises a stem securer, such as a nut, for securing the handle assembly on the sidewall of the toilet tank. The stem may be threaded and the stem securer may then be threadably coupled to the stem to secure the handle assembly on the sidewall of the toilet tank. The stem securer is preferably positioned on the inside of the toilet tank when the handle assembly is secured to the toilet tank.

Figure 5:
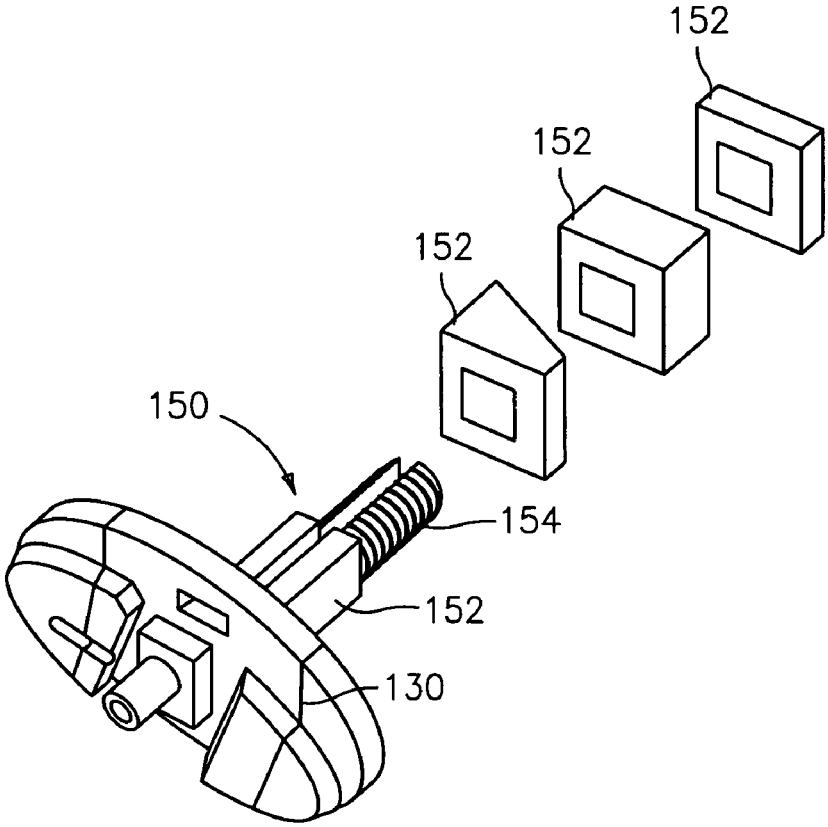
FIGS. 5–6 show more specifics of the handle assembly construction.
Figure 6:
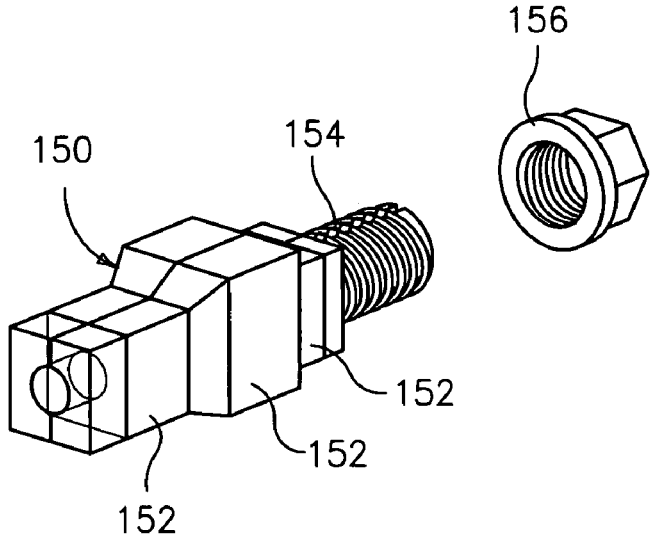
Figure 7:
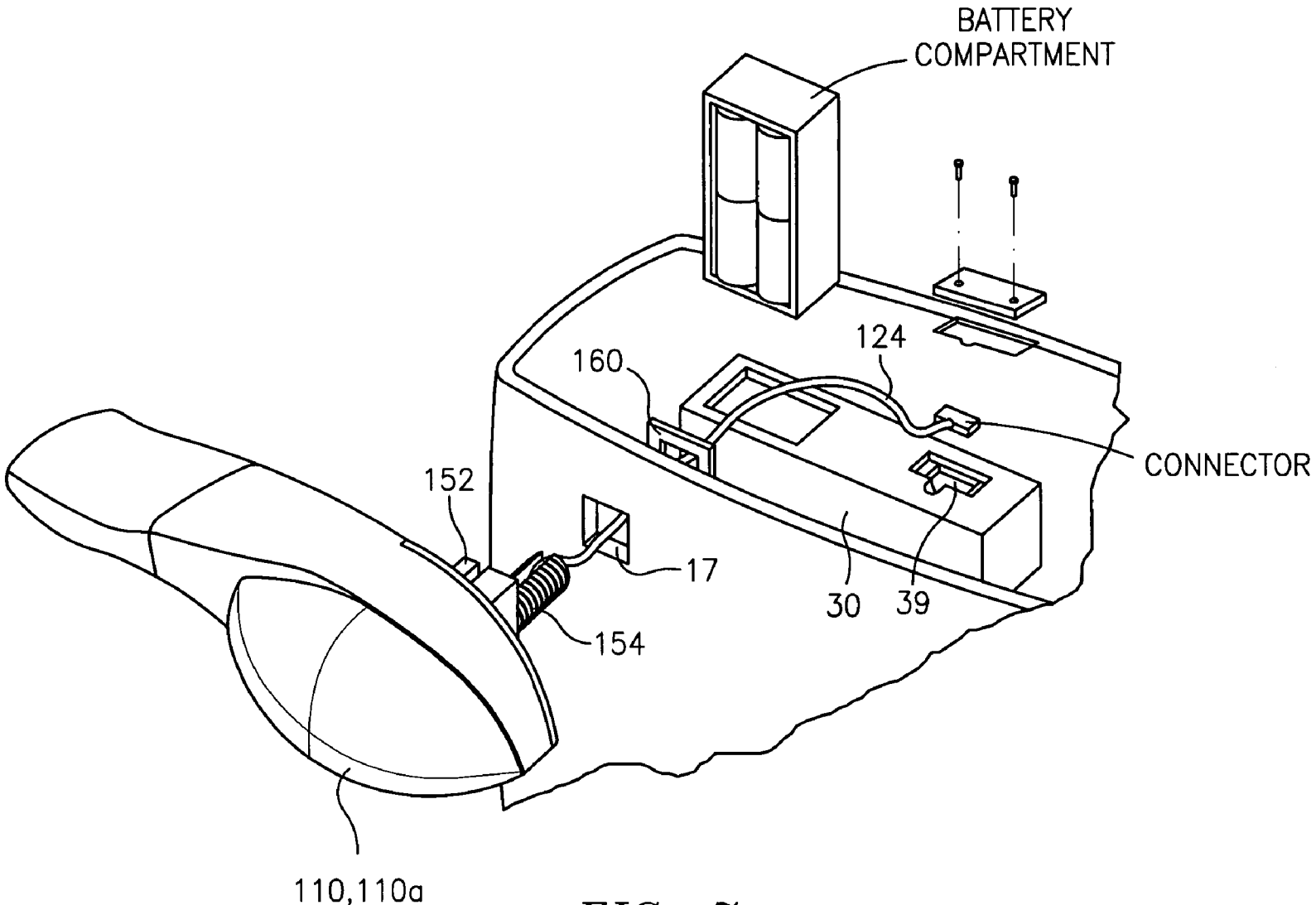
FIG. 7 shows a mounting arrangement of the handle assembly of FIG. 3, although it should be understood that the same mounting arrangement is applicable to the handle assembly of FIG. 4.

Reference is thus made to FIGS. 5–7 for a specific description of a preferred embodiment of other features of handle assembly 100, 100*a* which facilitates the mounting on toilet tank 14 and specifically, through aperture 17 (FIGS. 2, 7).

A stem, generally indicated at 150, preferably extends from a backside surface of faceplate 130. As illustrated in the Figures, stem 150 may be of varying lengths depending on the thickness of the sidewall 15 of tank 14 on which it is mounted. Typically, it has been found that aperture 17 is square-shaped (see FIG. 7). As such, one or more modular sections 152 may be provided to coordinate with the square-shaped opening 17. Of course, other shaped openings are contemplated hereby. Sections 152 may be releasably connected, added or removed to accommodate many sidewall thicknesses. It is preferable that stem 150 includes a threaded stem end section 154 that is passable through aperture 17 in sidewall 15 (any side of toilet tank 14 is considered a sidewall) of toilet tank 14. A stem securer, such as a nut 156, secures faceplate 130 and thus handle assembly 100, 100*a* on sidewall 15 of toilet tank 14. As such, stem securer 156 is threadably coupled to stem end section 154 to secure handle assembly 100, 100*a* on sidewall 15 of toilet tank 14. Stem securer 156 is positioned on the inside of the toilet tank (see FIG. 2) when the handle assembly is secured to the toilet tank. Of course, stem 150 may be integrally formed on the back of faceplate 130.

For clarity, it should now be well understood that handle assembly 100, 100*a* may be mounted on any sidewall of tank 14, such as a side sidewall (FIG. 13) or front sidewall (FIG. 2). In this way, retrofitting of the present invention into conventional and existing toilets is easily and readily achieved.

Reference will now be made to the remainder of the Figures to illustrate other particular features of the present invention.

Figure 8:
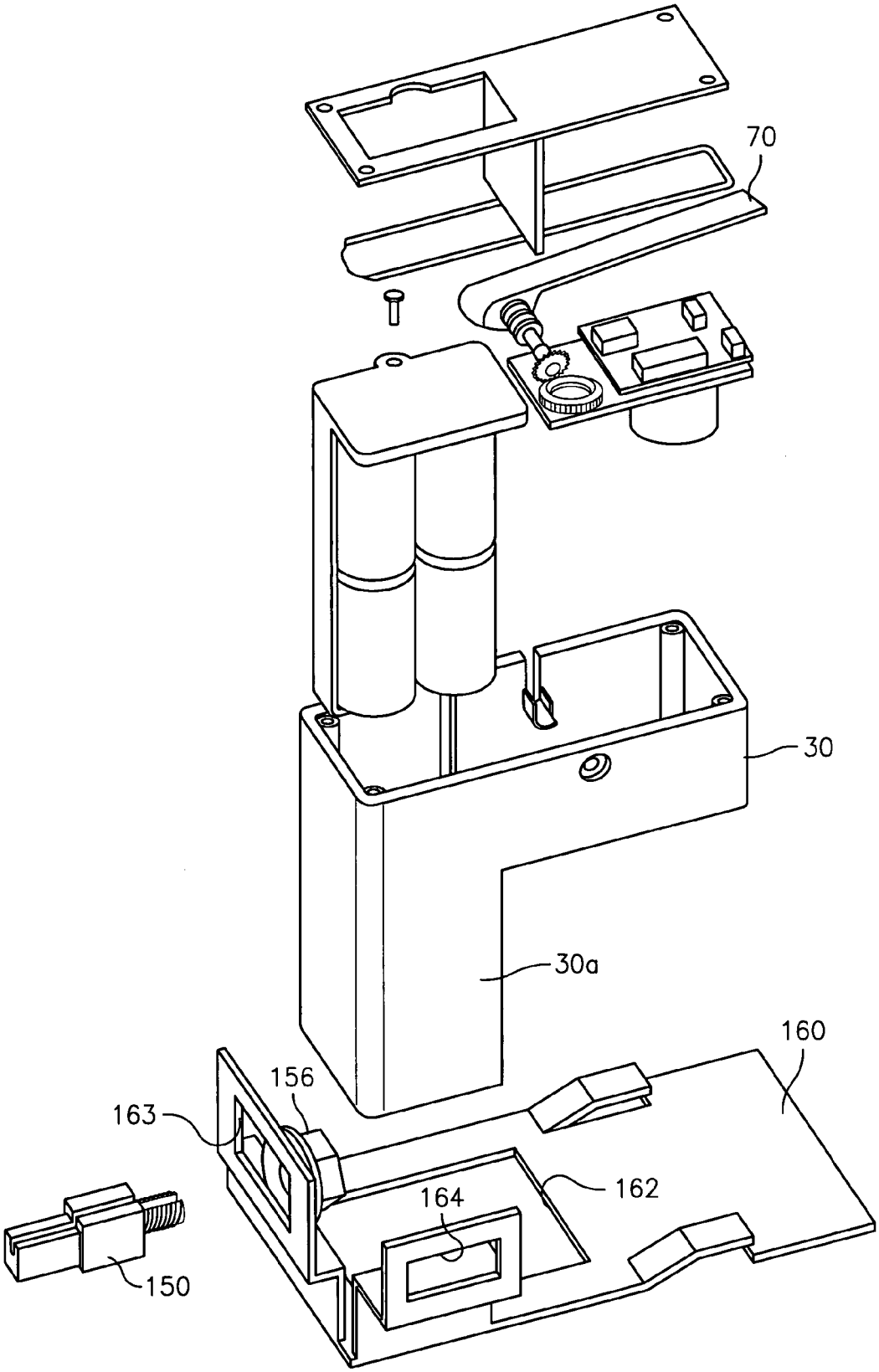
FIG. 8 shows a preferred mounting method for a handle assembly and a flush valve flapper lifting assembly of the present invention.

For example, FIG. 8 illustrates the use of a bracket 160 that is secured to handle assembly 100, 100*a*, such as onto stem 150, and then is further used to support flush valve lifting assembly 30 by having its housing 30*a* positioned into an aperture 162 thereof. Openings 163, 164 are both provided to provide multiple mounting positions of housing assembly 100, 100*a*, such as on a front or side sidewall of the toilet tank. More details of FIG. 8 will be made below.

Figure 9:
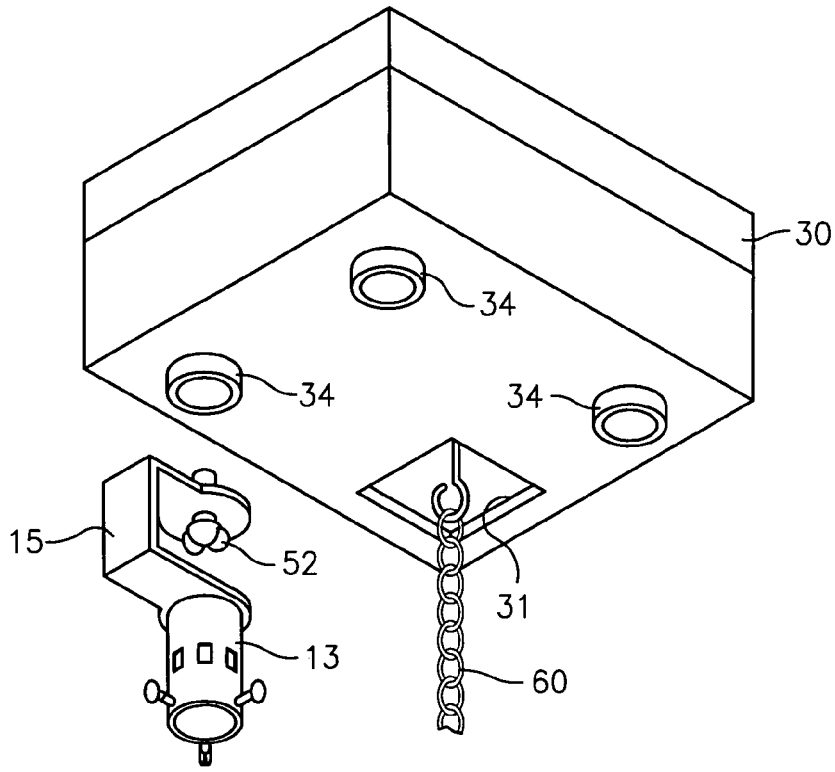
FIGS. 9 and 10 illustrate other preferred mounting methods of a flush valve flapper lifting assembly constructed in accordance with the present invention.
Figure 10:
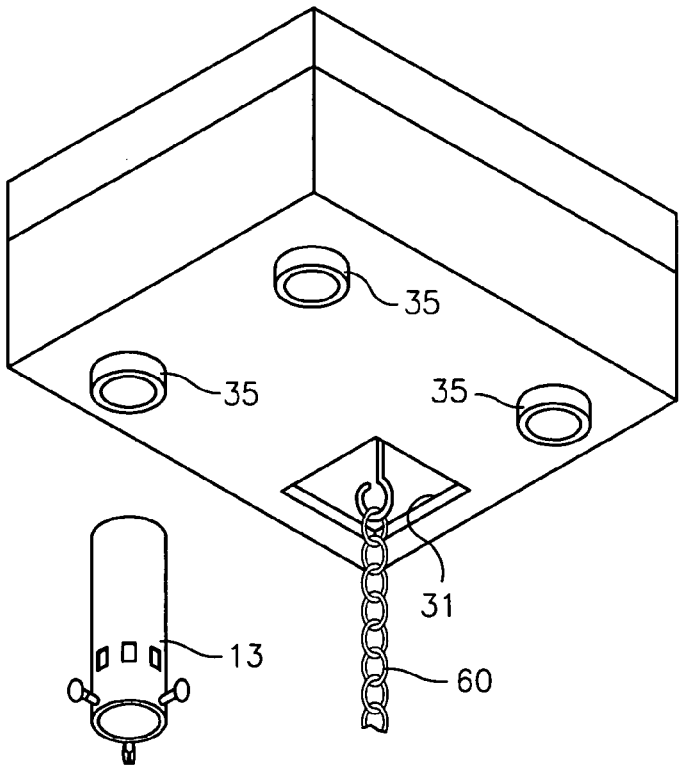

FIGS. 9–10 illustrate mounting alternatives of flush valve flapper lifting assembly 30 onto a conventional overflow tube 13. If a bracket 15 is used, the underside of flush valve flapper lifting assembly 30 may comprise one or more threaded holes 34. A screw 52 can be used to threadably couple overflow tube 13 to the underside of flush valve flapper lifting assembly 30. Providing a plurality of holes 34 allows for the accommodation of a plurality of toilet configurations, sizes and dimensions so as to achieve the proper alignment with flush valve 16 and thus provides for the most versatility of mounting thereof in toilet tank 14.

On the other hand, as illustrated in FIG. 10, the underside of flush valve flapper lifting assembly 30 may comprise one or more channels 35 which receive overflow tube 13 in a friction fit arrangement. Again, having more than one channels 35 provides versatility of the mounting of flush valve flapper lifting assembly 30, since a great advantage of the present invention is the ability to be received in any existing toilet with a tank.

A flush valve flapper lifter, achieved preferably by a chain 60, serves to cause the pivoting of flush valve flapper 19 from its closed position to its open position during the flushing.

Figure 11:
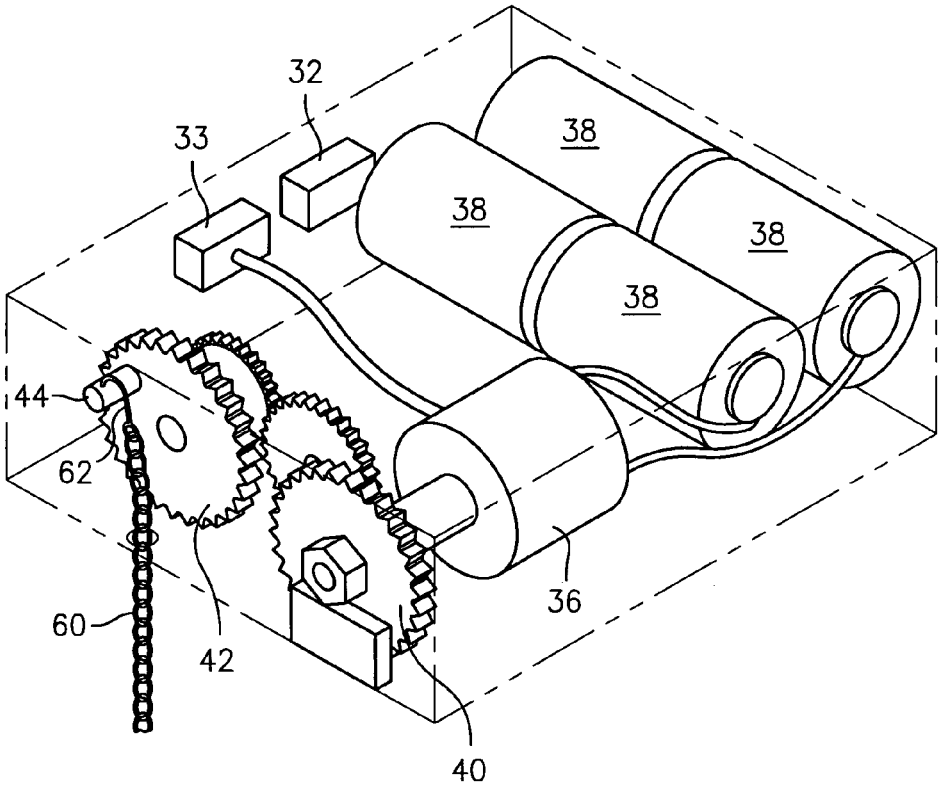
FIG. 11 is a perspective view of a gear train assembly for a flush valve flapper lifting assembly constructed in accordance with the present invention.

FIG. 11 more specifically illustrates the internal assembly of flush valve lifting assembly 30. To effectuate the "flush," flush valve lifting assembly 30 comprises a motor 36, that is operatively coupled to controller 33 and to flush valve flapper lifter 60. As should be clearly understood, the operation of motor 36 causes lifter 60, here in the form of a chain, to cause the pivoting of flush valve flapper 19 from its closed position to its open position during the flushing. Preferably, flush valve lifting assembly 30 is battery operated, and by way of example and not limitation, a plurality of batteries 38 may be used to power motor 36. In the preferred method, motor 36 operates upon receipt of an "operate" signal from controller 33 of assembly 30.

Flush valve lifting assembly 30 also preferably includes a gear train assembly, generally indicated at 40, comprising at least one gear operatively coupled to motor 36, and wherein flush valve flapper lifter 30 is operatively coupled to gear train assembly 40. One skilled in the art would certainly know how to construct a suitable gear train, taking into consideration the needed torque and gear turning ratios to effectuate a flush. For example, gear assembly 40 may be arranged vertically or horizontally, both configurations of which are within the scope of the invention.

As now clearly illustrated, the operation of motor 36 results in the rotation of the one or more gears of gear train assembly 40, thus causing flush valve flapper lifter 60 to pivot flush valve flapper 19 from its closed position to its open position.

In one embodiment, at the end of the gear train is an end wheel 42 with an extending arm 44. Arm 44 may have an opening or the like through which an end hook 62 of chain 60 can be connected. In this way, the ultimate rotation of wheel 42 will cause chain 60 to move upwardly through an opening 31 in the bottom of flush valve lifting assembly 30. Clearly, one skilled in the art would know where/how to orient arm 44 so that rotation of wheel 42 causes chain 60 to move upwardly and pull on chain 60.

As an alternative embodiment, instead of an arm 44, end wheel 42 may be provided with teeth on the circumference thereof, and a short shaft (not shown) with mating teeth may be provided in meshing engagement therewith. In this way, rotation of wheel 42 causes the shaft to move up and down vertically. The aforementioned chain 60, connected to the bottom of the shaft, can therefore also be made to move upwardly and downwardly to effectuate the flush. Still further, a lift arm, such as arm 70 (FIG. 8) may be used in a known manner.

Figure 12:
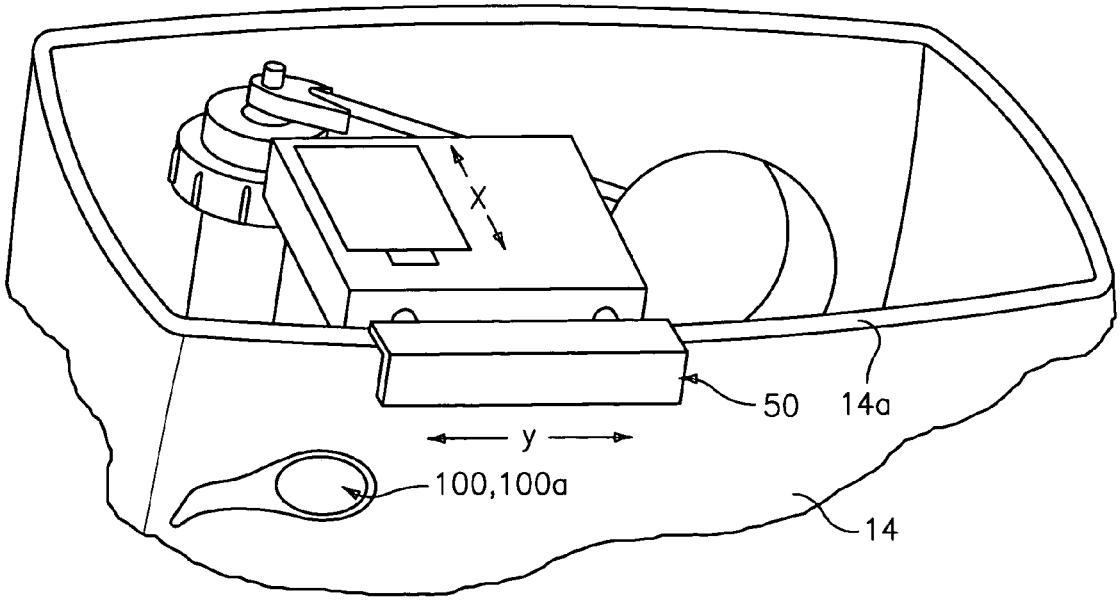
FIGS. 12–14 illustrate yet additional mounting methods for a flush valve flapper lifting assembly constructed in accordance with the present invention.
Figure 13:
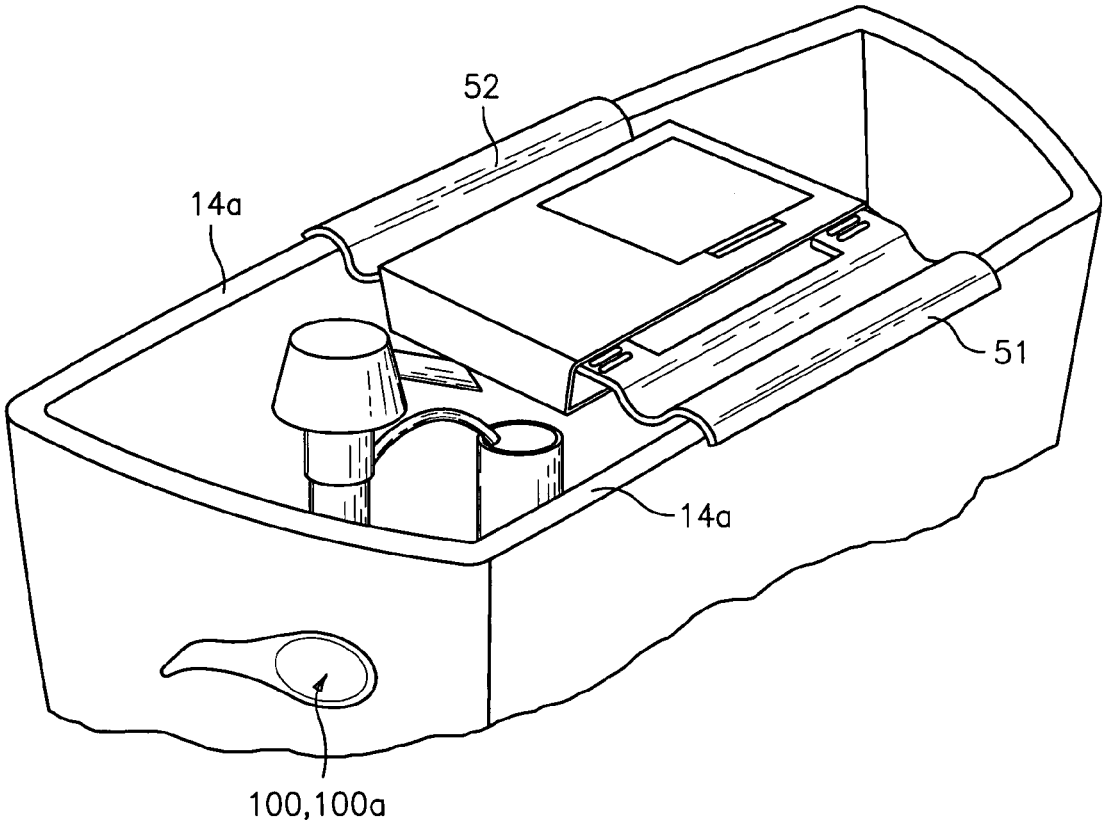
Figure 14:
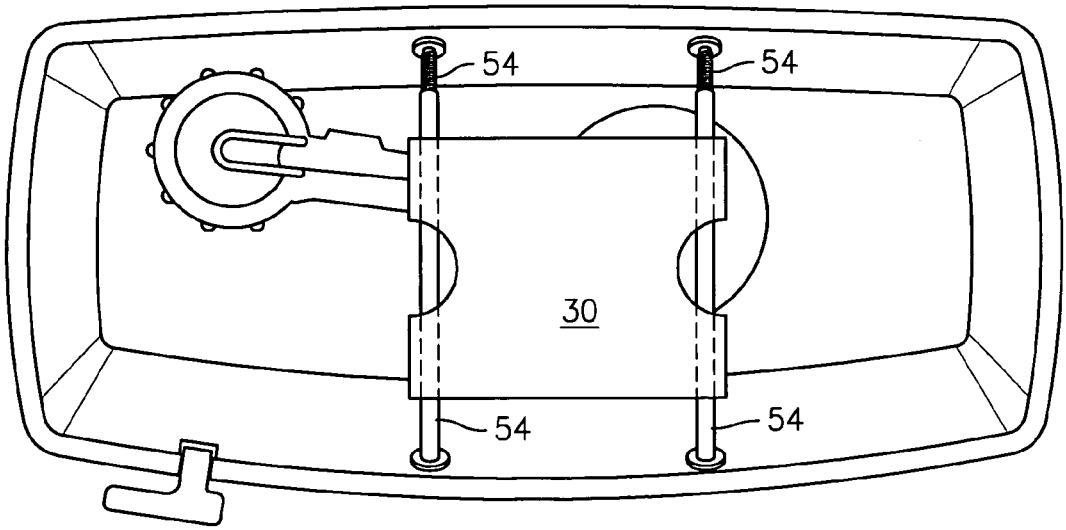

Reference is now made to FIGS. 12–14 to illustrate alternative mounting methods of flush valve flapper lifting assembly 30.

For example, the mounting method of FIG. 12 utilizes one elongated flange 50 that may adjustably extend from flush valve lifting assembly 30, such as, but not limited to, a side thereof. This flange 50 supports flush valve lifting assembly 30 on a rim 14*a* of toilet tank 14. Flange 50 may be adjustable so that the positioning of flush valve lifting assembly 30 can move in the "x" direction or may be slideable to allow for the movement of flush valve lifting assembly 30 in the "y" direction as well, again providing for versatility to achieve the desired/necessary alignment with the flush valve.

FIG. 13 illustrates further alternatives to the flange mounting method wherein a front flange 51 and a rear flange 52 are utilized to provide additional bracketing and support for the mounting of flush valve lifting assembly 30 on rim 14*a* of toilet tank 14. Again, preferably, flanges 51 and/or 52 are slidably extendable so as to maximize the retrofitting advantages provided by the present invention.

In yet another mounting configuration, FIG. 14 illustrates that adjustably extending "legs" 54 can be used to secure flush valve lifting assembly 30 in toilet tank 14. The legs may be screws that extend by rotation thereof, or may be telescoping friction fit "legs" with some means (not shown) to tighten them at their desired length against the inside walls of tank 14. Rubber grommets or other devices can be used to secure flush valve lifting assembly 30 to the inner walls of toilet tank 14. Such legs 54 may also be adjustably angled or pivoted in a plurality of directions, all in an effort to maximize and achieve the retrofitting abilities and advantages provided by the present invention.

Figure 15:
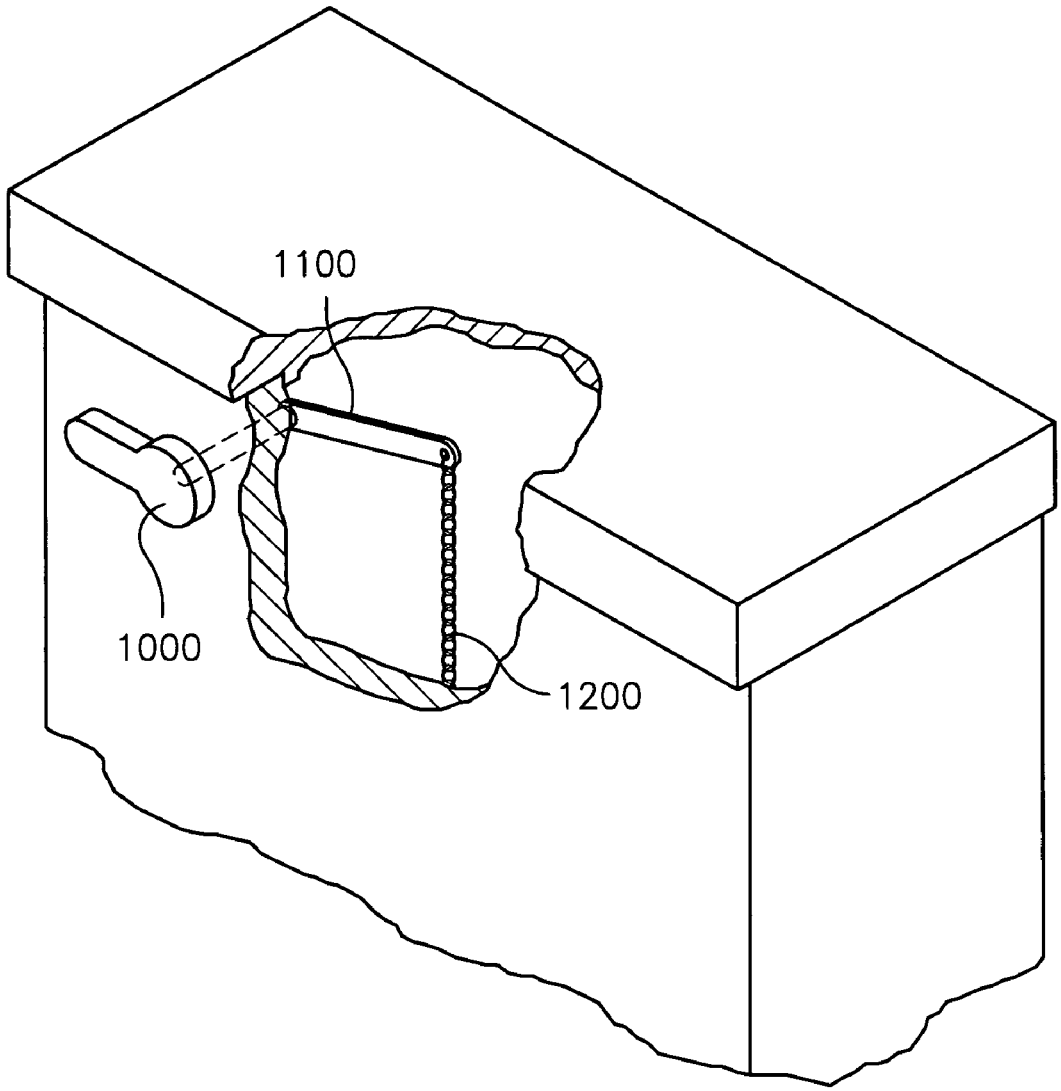
FIG. 15 (PRIOR ART)
FIG. 15 is a perspective view of a toilet with a toilet tank shown partially cut away, having an autoflush system constructed in accordance with the prior art, most importantly illustrating a conventional handle comprising a lift arm to lift a conventional chain to pivot a conventional flush valve flapper.

FIG. 15 illustrates the use of a lift arm 1100 connected to a conventional handle 1000, with the end of a chain 1200 may be directly connected thereto. Manually rotating handle 1000, in this case counterclockwise, causes lift arm 1100 to lift chain 1200 in a conventional manner. This type of conventional arrangement, namely having a toilet tank with an aperture through a sidewall through which a conventional handle, comprising a lift arm to lift a conventional chain to pivot a conventional flush valve flapper, is precisely the type of arrangement the present invention is designed and contemplated to replace.

Lastly, returning briefly to FIG. 8, it can thus be seen that this particular arrangement of assembly 30 utilizes such a lift arm (or flush valve flapper lifter) 70, to which a chain (not shown) is connected. All other features of this assembly 30 can be found in other Figures, and are therefore deemed to be incorporated therein. Moreover, while each assembly 30 in each Figure may not specifically illustrate each feature, it should be understood that one skilled in the art should be able to view other figures in order to implement the desired assembly construction, and the figures and description herein should be so broadly construed. Likewise the FIG. 8 construction could easily use the flush valve flapper lifter of any of the other Figures, and visa versa.

The handle assembly may also include a pushbutton for automatically sending a "finished" signal to the controller, wherein in response to receipt of the "finished" signal from the pushbutton, the controller transmits the "flush" signal to the flush valve lifting assembly to initiate a flush.

It will thus be seen that the present invention is both patentably different from and a significant improvement over the cited prior art. Specifically, the present invention more easily lends itself into being retrofittable in an existing toilet of the type having a toilet tank. The unique configuration wherein the sensor and flush valve lifting assembly 30 communicate with each other facilitates the ability for the autoflush system of the present invention to be retrofitted into a wide range of existing toilet configurations. Also, the unique construction wherein the disclosed handle assembly is mounted in place of and where a conventional handle would be mounted, allows for easy retrofitting without the need for additional drilling and or cutting of the tank.

While the invention has been particularly shown and described with respect to preferred embodiments thereof, it will be understood by those skilled in the art that changes in form and details may be made therein without departing from the scope and spirit of the invention.

What is claimed is:

1. An arrangement for flushing a toilet of the type that comprises a toilet bowl and a toilet tank operatively coupled to the toilet bowl, wherein the toilet tank has a flush valve which provides a conduit for water to flow from the toilet tank to the toilet bowl when the toilet is flushed, wherein the flush valve includes a valve seat and a pivotable flush valve flapper which opens and closes the valve, wherein the arrangement comprises:

a flush valve flapper lifting assembly, positioned in the toilet tank, for pivoting the flush valve flapper from its closed position to its open position in response to a flush signal;

a handle assembly comprising a manually actuatable handle, operatively coupled to the flush valve flapper lifting assembly, for providing the flush signal to the flush valve flapper lifting assembly;

wherein the handle assembly transmits the flush signal to the flush valve flapper lifting assembly in response to manual actuation of the handle.

2. The arrangement as claimed in claim 1, wherein the handle assembly detects manual actuation of the handle.

3. The arrangement as claimed in claim 1, wherein the handle assembly comprises a switch for detecting manual actuation of the handle.

4. The arrangement as claimed in claim 1, wherein the handle assembly comprises means for detecting manual actuation of the handle.

5. The arrangement as claimed in claim 1, including a wire for electrically coupling the handle assembly to the flush valve flapper lifting assembly, wherein the flush signal is transmitted from the handle assembly to the flush valve flapper lifting assembly via the wire.

6. The arrangement as claimed in claim 1, wherein the handle assembly comprises a transmitter for transmitting the flush signal to the flush valve flapper lifting assembly and the flush valve flapper lifting assembly comprises a receiver for receiving the flush signal transmitted by the handle assembly.

7. The arrangement as claimed in claim 6, wherein the flush signal is transmitted by the transmitter of the handle assembly to the receiver of the flush valve flapper lifting assembly by one of IR, PIR, RF, light or sonar.

8. The arrangement as claimed in claim 3, wherein the switch is comprised of an assembly that one of (i) operates by the detection or changing of a magnetic field, (ii) is operated by a switch position change, (iii) that comprises a coil plunger core arrangement operating signal, (iv) that uses a magnet in conjunction with a Hall-effect transistor, or (v) utilizes a circuit capacitance change.

9. The arrangement as claimed in claim 1, wherein the handle assembly comprises at least one sensor for detecting the presence of a user in a target area.

10. The arrangement as claimed in claim 9, wherein the flush signal is transmitted by the handle assembly to the flush valve flapper lifting assembly after the user has exited the target area.

11. The arrangement as claimed in claim 9, wherein the at least one sensor comprises:

a transmitter for emitting at least one radiation beam to the target area; and a detector being responsive to a reflected radiation beam emitted from the radiation beam transmitter and reflected oft of a user in the target area.

12. The arrangement as claimed in claim 11, wherein the handle assembly comprises a controller that is responsive to a signal from the detector that is indicative of the intensity of the reflected beam.

13. The arrangement as claimed in claim 12, wherein the controller transmits the flush signal to the flush valve flapper lifting assembly depending on the signal transmitted from the detector.

14. The arrangement as claimed in claim 9, wherein the flush valve lifting assembly commences a flushing upon receipt of the flush signal from the handle assembly.

15. The arrangement as claimed in claim 1, wherein the flush valve lifting assembly comprises:

a motor;

a flush valve flapper lifter, operatively coupled to the motor, for causing the pivoting of the flush valve flapper from its closed position to its open position during the flushing.

16. The arrangement as claimed in claim 15, including a gear train assembly comprising at least one gear operatively coupled to the motor, and wherein the flush valve flapper lifter is operatively coupled to the gear train assembly;

wherein the operation of the motor results in the rotation of the at least one gear thus causing the flush valve flapper lifter to pivot the flush valve flapper from its closed position to its open position.

17. The arrangement as claimed in claim 1, wherein the handle assembly is mounted on a sidewall of the toilet tank.

18. The arrangement as claimed in claim 17, wherein the toilet tank comprises an aperture through which a handle is mountable, and wherein the handle assembly is secured to the tank through the aperture.

19. The arrangement as claimed in claim 1, wherein the flush valve flapper lifting assembly is coupled to an overflow tube positioned in the toilet tank.

20. The arrangement as claimed in claim 19, wherein the underside of the flush valve flapper lifting assembly comprises one or more spaced apart holes or channels to which the overflow tube is coupled.

21. The arrangement as claimed in claim 1, including at least one elongated flange coupled to the flush valve lifting assembly, for supporting the flush valve lifting assembly on a rim of the toilet tank, wherein the flange is slideably adjustable;

whereby the position of flush valve lifting assembly in the tank toilet is adjustable.

22. The arrangement as claimed in claim 1, including at least one leg coupled to the flush valve lifting assembly, for supporting the flush valve lifting assembly in the toilet tank, wherein the at least one leg is lengthwise adjustable;

whereby the position of flush valve lilting assembly in the tank toilet is adjustable.

23. A flush valve actuation arrangement for replacing a flushing assembly of the type used for flushing a toilet of the type that comprises a toilet bowl and a toilet tank operatively coupled to the toilet bowl, wherein the toilet tank has a flush valve which provides a conduit for water to flow from the toilet tank to the toilet bowl when the toilet is flushed, wherein the flush valve includes a valve seat and a pivotable flush valve flapper which opens and closes the valve, wherein the flush valve actuation assembly comprises:

a handle assembly that comprises at least one sensor for detecting the presence of a user in a target area; and a flush valve flapper lifting assembly, operatively coupled to the handle assembly and positioned in the toilet tank, for pivoting the flush valve flapper from its closed position to its open position in response to a flush signal;

wherein the handle assembly transmits the flush signal to the flush valve flapper lifting assembly; and wherein the toilet tank comprises an aperture through a sidewall through which a conventional handle, comprising a lift arm to lift a conventional chain to pivot a conventional flush valve flapper, is mountable, and wherein the handle assembly is secured to the toilet tank through the aperture.

24. The arrangement as claimed in claim 23, wherein the handle assembly comprises a stem that is passable through the aperture in the sidewall of the toilet tank, and wherein the handle assembly comprises a stem securer for securing the handle assembly on the sidewall of the toilet tank.

25. The arrangement as claimed in claim 23, wherein the stem is threaded and the stem securer is threadably coupled to the stem to secure the handle assembly on the sidewall of the toilet tank.

26. The arrangement as claimed in claim 25, wherein the stem securer is positioned on the inside of the toilet tank when the handle assembly is secured to the toilet tank.

27. The arrangement as claimed in claim 23, wherein the handle assembly comprises a manually actuatable handle, operatively coupled to the flush valve flapper lifting assembly, for providing the flush signal to the flush valve flapper lifting assembly;

wherein the handle assembly transmits the flush signal to the flush valve flapper lifting assembly in response to manual actuation of the handle.

28. The arrangement as claimed in claim 27, wherein the handle assembly detects manual actuation of the handle.

29. The arrangement as claimed in claim 23, including a wire for electrically coupling the handle assembly to the flush valve flapper lifting assembly, wherein the flush signal is transmitted from the handle assembly to the flush valve flapper lifting assembly via the wire.

30. The arrangement as claimed in claim 23, wherein the handle assembly comprises a transmitter for transmitting the flush signal to the flush valve flapper lifting assembly and the flush valve flapper lifting assembly comprises a receiver for receiving the flush signal transmitted by the handle assembly.

31. The arrangement as claimed in claim 23, wherein the at least one sensor comprises:

a transmitter for emitting at least one radiation beam to the target area; and a detector being responsive to a reflected radiation beam emitted from the radiation beam transmitter and reflected off of a user in the target area.

32. The arrangement as claimed in claim 23, wherein:

the handle assembly comprises a controller that is responsive to a signal from the sensor that is indicative of the intensity of the reflected beam;

the controller transmits the flush signal to the flush valve flapper lifting assembly depending on the signal transmitted from the sensor; and the flush valve lifting assembly commences a flushing upon receipt of the flush signal from the at least one sensor.

33. A handle assembly to be mounted on a sidewall of a toilet tank of a toilet, the toilet being of the type that comprises a toilet bowl and a toilet tank operatively coupled to the toilet bowl, wherein the toilet tank has a flush valve which provides a conduit for water to flow from the toilet tank to the toilet bowl when the toilet is flushed, wherein the flush valve includes a valve seat and a pivotable flush valve flapper which opens and closes the valve, and a flush valve flapper lifting assembly, positioned in the toilet tank, for pivoting the flush valve flapper from its closed position to its open position in response to a flush signal, wherein the handle assembly comprises:

a manually actuatable handle, operatively coupleable to the flush valve flapper lifting assembly, for providing a flush signal to the flush valve flapper lifting assembly;

wherein the handle assembly transmits the flush signal to the flush valve flapper lifting assembly in response to manual actuation of the handle.

34. The assembly as claimed in claim 33, including a wire for electrically coupling the handle assembly to the flush valve flapper lifting assembly, wherein the flush signal is transmitted from the handle assembly to the flush valve flapper lifting assembly via the wire.

35. The assembly as claimed in claim 33, wherein the handle assembly comprises a transmitter for transmitting the flush signal to the flush valve flapper lifting assembly and the flush valve flapper lifting assembly comprises a receiver for receiving the flush signal transmitted by the handle assembly.

36. The assembly as claimed in claim 33, wherein the handle assembly comprises:

a switch for detecting manual actuation of the handle; and at least one sensor for detecting the presence of a user in a target area.

37. The assembly as claimed in claim 36, wherein the flush valve lifting assembly commences a flushing upon receipt of the flush signal from the handle assembly.

38. The arrangement as claimed in claim 37, wherein the handle assembly is mounted on a sidewall of the toilet tank and wherein the toilet tank comprises an aperture through which a handle is mountable, and wherein the handle assembly is secured to the tank through the aperture.

39. The assembly as claimed in claim 38, wherein the handle assembly comprises a stem that is passable through the aperture in the sidewall of the toilet tank, and wherein the handle assembly comprises a stem securer for securing the handle assembly on the sidewall of the toilet tank.

* * * * *

UNITED STATES PATENT AND TRADEMARK OFFICE

CERTIFICATE OF CORRECTION

PATENT NO. : 7,032,256 B2
APPLICATION NO. : 10/685826
DATED : April 25, 2006
INVENTOR(S) : Carl D. Contadini It is certified that error appears in the above-identified patent and that said Letters Patent is hereby corrected as shown below:

Column 10, Line 63, delete “oft” and replace it with --off--

Column 11, Line 47, delete “lilting” and replace it with “lifting”

Signed and Sealed this

Twenty-fifth Day of July, 2006

JON W. DUDAS
*Director of the United States Patent and Trademark Office*